US010418013B2

(12) United States Patent
McKenna et al.

(10) Patent No.: US 10,418,013 B2
(45) Date of Patent: Sep. 17, 2019

(54) ANALOG RECALL SYNTHESIZER HAVING PATCH AND KNOB RECALL

(71) Applicant: LAFAYETTE COLLEGE, Easton, PA (US)

(72) Inventors: Corey M. McKenna, Easton, PA (US); Ben A. Sidell, Easton, PA (US); James W. Erario, Easton, PA (US); Brian R. Duke, Easton, PA (US); Willem P. Ytsma, Easton, PA (US); Nate Fowler, Easton, PA (US); Steven G. Shaw, Easton, PA (US); Kyle E. Polinski Frost, Easton, PA (US); Kimberly R. Dupuis, Easton, PA (US); Nathanial E. Shipp, Easton, PA (US); Daniel Sabatino, Easton, PA (US); Michael Tritter, Easton, PA (US); Al Sgro, Easton, PA (US)

(73) Assignee: Lafayette College, Easton, PA (US)

( * ) Notice: Subject to any disclaimer, the term of this patent is extended or adjusted under 35 U.S.C. 154(b) by 0 days.

(21) Appl. No.: 15/979,127

(22) Filed: May 14, 2018

(65) Prior Publication Data

US 2018/0330708 A1 Nov. 15, 2018

Related U.S. Application Data

(60) Provisional application No. 62/505,534, filed on May 12, 2017.

(51) Int. Cl.
*G10H 7/00* (2006.01)
*G10H 5/00* (2006.01)
(Continued)

(52) U.S. Cl.
CPC ..... *G10H 5/002* (2013.01); *G10H 1/0558* (2013.01); *G10H 7/02* (2013.01); *G10H 7/10* (2013.01)

(58) Field of Classification Search
CPC ..... G10H 2240/145; G10H 2240/165; G10H 1/18; G10H 1/36; G10H 2240/295;
(Continued)

(56) References Cited

U.S. PATENT DOCUMENTS

2004/0144241 A1* 7/2004 Juskiewicz ..... G10H 1/0058 84/723
2004/0206226 A1* 10/2004 Negoescu ..... G10H 7/006 84/600

(Continued)

*Primary Examiner* — Marlon T Fletcher
(74) *Attorney, Agent, or Firm* — Vos-IP, LLC

(57) ABSTRACT

A sound generating analog synthesizer that is comprised of potentiometers, a switch or switches and a set of patch jacks has a control system that can be operated in three modes, a manual mode, an automatic mode, and a guided mode; wherein manual mode allows potentiometer and switch positions as well as patch cable connections to be set by hand; wherein automatic mode, automatically sets patch connections as on or off, as well as set potentiometer positions and switch states with electromechanical or electrical devices; and wherein the guided mode provides at least one visual information on how to change the potentiometer positions, switch states and patch jack connections such that a previously obtained sound can be reproduced.

16 Claims, 6 Drawing Sheets

(51) Int. Cl.

| | |
|---|---|
| ***G10H 7/02*** | (2006.01) |
| ***G10H 7/10*** | (2006.01) |
| ***G10H 1/055*** | (2006.01) |

(58) Field of Classification Search
CPC ..... G10H 1/32; G10H 1/348; G10H 1/055; G10K 15/02
See application file for complete search history.

(56) References Cited

U.S. PATENT DOCUMENTS

| | | | | |
|---|---|---|---|---|
| 2009/0064850 | A1* | 3/2009 | Lengeling | G10H 1/20 84/634 |
| 2013/0087037 | A1* | 4/2013 | Dreher | G10H 1/0066 84/645 |
| 2018/0330704 | A1* | 11/2018 | Murr | G10H 1/34 |

* cited by examiner

ANALOG RECALL SYNTHESIZER HAVING PATCH AND KNOB RECALL

PRIORITY CLAIM

This application claims priority to U.S. Provisional Patent Application No. 62/505,534, filed May 12, 2017, which is hereby incorporated by reference in its entirety.

FIELD OF INVENTION

The present application is related to an analog synthesizer device that includes a controller to automate electro-mechanical components to allow for generation of particular sound wave forms and recall of a stored sound generation settings on an otherwise analog device.

BACKGROUND OF INVENTION

Current analog synthesizer techniques have limited capability to allow the user to be guided to create a previous sound. Furthermore, it is difficult for the user to accurately document and reproduce same sound due to the complexity of the device and the nearly unlimited positions that can be generated through the various patches connections, switches, and knobs.

Currently the process to recall a sound is semi-digital where a rotary potentiometer knob position does not directly correspond to a voltage used by a synthesizer module. These are called "infinite knobs" and the physical position does not correlate to a particular setting. To see the value of the setting the user must look at a numeric display. This makes it difficult to "play" as an instrument. Furthermore, currently there is no analog synthesizer that can store the patch connections between modules as they are made by manually plugging cables into sockets on the modules. This limitation therefore prevents complete functionality of the device, except through pure mechanical re-organization of these patches.

Current wave form generating techniques typically use "modules", such as function generators, pitch generators, arbitrary waveform generators, digital pattern generators and frequency generators, and are limited by existing methods which involves understanding the function of numerous knobs as well as different ways to connect or electrically "patch" modules together.

While in existence, additive wave form generating, such as a Wave Form Generating App, enables the waveform generation of complex wave designs created by a drawing from a stylist or finger, but has been restricted to digital sound generation. Accordingly, there remains a lack of innovation and development of analog devices that are capable of performing aspects that are otherwise solely available in a digital synthesizer device. Herein, is described embodiments of analog synthesizers having automated components to enable storage and recall to a particular wave form, or of creation of settings matching a wave form.

SUMMARY OF INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The present invention describes an analog potentiometer position, switch state and patch connection recall that can retrieve previously saved potentiometer positions, switch positions and patch connections either automatically or by guiding the user in order to reproduce a specific sound. The present invention further describes a device that allows the user to draw and edit wave forms using the analog potentiometer, switch and patch connection recall synthesizer. Furthermore, once a waveform is created, the characteristics of said wave form correspond to switch positions, knob positions and patch connections that the synthesizer can set automatically or guide the user to create the said waveform on the synthesizer.

The present invention is drawn to a method to produce a sound a user creates on an analog synthesizer, for example the device for the application is selected from but not limited to, a hand-held device, digital devices and mobile phones. A Wave Form Generating Application is a method to create a waveform. The waveform can be shaped, edited by the application or the synthesizer. The interaction between the Application and Synthesizer is a method to have a visual input and feedback to create music.

A preferred embodiment is directed towards a method to reproduce a sound a user creates on an analog synthesizer. The analog synthesizer comprising a plurality of indicators of which knobs, patch connections and switches are selected from but not limited to lights, LCD screens, motorized knobs and switches. These components generate a user generated or self-guiding patch connection recall that is a method comprised of patch jacks and displays that direct the user to create a previous sound. The self-guiding knob recall is a method comprised of knobs and displays that direct the user to create a previous sound.

The automatic knob recall is a method comprised of knobs, motors and displays that mechanically moves the knob to a previous position.

The automatic switch recall is a method comprised of switches, displays and electronically actuated switches that connect analog synthesizer electrical signals without requiring action from the user.

The automatic patch connection recall is a method comprised of jacks, displays and electronic switches that connect the modules without requiring action from the user.

The present invention describes an analog recall synthesizer device that can recall saved knob positions, switch positions and patch connections either automatically or by guiding the user in order to reproduce a specific sound.

The present invention further describes a device that allows the user to draw and edit wave forms using the analog recall synthesizer. Once a waveform is created, the characteristics of said wave form correspond to switch positions, knob positions and patch connections that the synthesizer can set automatically or guide the user to create the said waveform on the synthesizer.

The present invention is drawn to a method to produce a sound a user creates on an analog synthesizer, for example the device for the application is selected from but not limited to, a hand-held device, digital devices and mobile phones.

A particular method to create a waveform is described by drawing a waveform on an electronic device; wherein said electronic device is electronically connected to an analog synthesizer; modifying the knob positions, switch states and or patch connections on the analog synthesizer to match the sound wave generated; and then shaping or editing the wave form by the application or the synthesizer. This method allows for interaction between the Application and Synthesizer to impart visual input and feedback to create music.

A particular embodiment is directed towards an analog synthesizer that is capable of generating or reproducing a sound a user creates on an analog synthesizer; wherein the analog synthesizer comprises a set of indicators selected from the group consisting of knobs, patch connections, switches, and combinations thereof; and wherein these features are selected from but not limited to lights, LCD screens, motorized knobs and switches.

In certain embodiments, the knobs on the analog synthesizer are motorized to allow for modification of the synthesizer to a predetermined position selected from patch jacks and lights that direct the user to create a previous sound. In other embodiments, the self-guiding knob recall is a method comprised of knobs and displays that direct the user to create a pervious sound.

A particular embodiment comprises an analog synthesizer having the ability to recall a sound, the synthesizer comprises a plurality of knobs, motors, and lights; wherein the motorized knob recall is generated through a series of knobs, motors and lights that mechanically moves the knob to a previous position. To create a further sound, it may be necessary to have a patch recall component, wherein the automatic patch recall is comprised of jacks, displays and electronic switches that connect the modules without requiring action from the user.

Accordingly a method of recalling a sound on an analog synthesizer comprises identifying a sound to create having a predetermined set of positions for at least one knob and at least one patch and at least one switch; modifying at least one knob, at least one patch and at least one switch on an analog synthesizer to match a predetermined position.

An analog synthesizer comprising a knob recall system comprising at least one knob, wherein said knob is connected to a signal potentiometer, a position sensor, and a motor, which generates a wave form. Certain embodiments further comprising at least one patch connection, wherein said patch connection comprises a male connector having an audio signal, a position signal and a ground on different portions of said connector, and a receive for said male connector wherein a controller detects the presence of a male connector in one or more of the audio, position, or ground positions.

In certain embodiments, a patch further comprises an on/off component, wherein the patch can be electronically activated or deactivated.

In preferred embodiments, the analog synthesizer further comprises an electronic application connected to said synthesizer, wherein said electronic application can measure and detect the signal potentiometer and position sensor to drive said motor. In certain embodiments, the electronic application comprises at least one input for receiving information from the synthesizer and at least one output. In further embodiments, the electronic application generates a wave form, and wherein the application comprises a processor to receive information from the signal potentiometer, position sensor and from the resulting waveform generated, and modifies the position of the at least one knob via the motor, to modify the wave form.

In certain embodiments, the synthesizer as described herein comprises a recall system, which enables a user to return the knob used to control a parameter of a synthesizer to a specified physical position. In other embodiments, the desired knob position can be achieved by an electronic display that guides the user back to said position by providing visual information that directs the user to the position, or wherein desired knob position can be achieved without direct user interaction with knob by means of the motor.

The embodiments also include an electronic musical system comprising: a computer implemented program, a display, and an analog synthesizer; the analog synthesizer comprising at least one knob having a motor, signal potentiometer, and position sensor, wherein the computer implemented program is capable of electronically communicating with said motor, signal potentiometer, and position sensor to rotate said knob; the display being electronically connected to the computer implemented program and displaying an output or input of a wave form; wherein said display providing a wave form being created by said synthesizer, and wherein modification of the wave form on the display results in modification of the knob position to change the synthesizer to create that wave form. Certain embodiments of the system further comprise at least one patch having a first connector having a position signal, an audio signal, and a ground, and at least one receiver for said first connector capable of detecting the position signal, audio signal and ground; wherein the computer implemented program can turn on or off the patch to modify the wave form.

Further embodiments of the system allow a user to specify the desired sound in the form of an audio wave created through the display. The system can thereafter determine appropriate settings for the analog electronic synthesizer that will produce settings that match the desired wave form as closely as possible. Alternatively, the system comprises an electronic display on a knob, wherein said electronic display indicates a desired knob position to generate a particular wave form.

One embodiment of the synthesizer setting change action uses a fixed set of modules, a "semi-modular" synthesizer, that are integrated into the system that controls the input parameters.

In a further embodiment, a method of creating a wave form on an analog synthesizer comprising: adjusting at least one knob on an analog synthesizer; wherein said analog synthesizer is electronically connected to a computing device, wherein said computing device receives an input from said analog synthesizer detailing the wave form being generated, and wherein the computing device electronically controls the at least one knob to modify the position to create the wave form.

A further embodiment is directed towards an interface system for creating analog synthesizer wave forms comprising: an electronically controllable analog synthesizer having at least one motorized and controllable knob, a computer implemented program and a display; wherein said computer implemented program connects to and is in communication with said at least one motorized controllable knob; and wherein said display provides a visual orientation of a generated wave form. The interface system wherein said display provides a first display of a generated wave form and second display of a predetermined wave form, or wherein said computer implemented program modifies the at least one motorized and controllable knob to match the first wave form to the predetermined wave form.

A preferred embodiment is directed towards a sound generating analog synthesizer comprising a controller electronically connected to rotate at least one knob, actuate at least one switch, and make at least one patch connection; said knob comprising a drive system, a shaft position sensor, and a potentiometer; wherein said controller rotates at least one knob by generating instructions to said drive system; said at least one switch comprising an electronic connection to said controller to turn on or off said switch upon receiving instructions from said controller; and at least one patch connection, comprising at least one patch switch, wherein said at least one patch switch controls connection between at least one input of said patch and at least one output of said patch.

A preferred embodiment wherein said potentiometer detects a position of said knob.

A preferred embodiment, wherein the sound generating analog synthesizer comprising at least one of the group selected from: a knob position display, a switch display, a patch connection display, or combinations thereof. A preferred embodiment wherein a knob position display, a switch display, or a patch connection display generates an indication identifying a current position and a desired position, wherein said desired position corresponds to a pre-determined sound wave. A preferred embodiment wherein the controller can electronically modify each of at least one knob, at least one switch, and at least one set of patch connections.

In a preferred embodiment, a sound generating analog synthesizer, further comprising an electronic interface suitable for drawing or entering mathematical parameters of a wave form capable of being generated via modification of the at least one knob, at least one switch, and at least one set of patch connections. A preferred embodiment further comprising at least one of the group selected from: a knob position display, a switch display, a patch connection display, or combinations thereof, wherein a wave form of said electronic interface correspond to a particular knob position, switch position, and patch connections, and wherein the position corresponding to a wave form is indicated by an indicator on the knob position display, switch display, patch connection display or a combination thereof. A preferred embodiment wherein said controller comprises a control system comprising computer software defined to control at least one knob, at least one switch, and at least one set of patches, and said controller can receive information from the analog synthesizer control system and display data regarding the potentiometer, switch and patch settings.

In a preferred embodiment, a sound generating analog synthesizer comprising an electronic application and memory configured to said controller, enabling the controller to transmit information to the analog synthesizer controller to change the position of the potentiometer, state of the switches, or state of the patch connections. In a preferred embodiment, wherein the memory configured to said controller enables storage of all of the potentiometer, switch and patch connection settings required to create a particular sound in electronic memory. A preferred embodiment wherein the analog synthesizer can recall the potentiometer, switch and patch connection settings to re-create a stored sound. A preferred embodiment, wherein the controller can restore a previous state by using an electronic display that guides the user to manually position the potentiometers to the stored setting, set the state of the switches and set the state of the patch connections. A preferred embodiment wherein the controller can restore a previous state by automatically modifying the potentiometer, switch and patch connections without user assistance.

In a preferred embodiment of a sound generating analog synthesizer, wherein the controller is connected to a display, wherein said display depicts the sound wave being generated by the analog synthesizer as a waveform. A preferred embodiment wherein the waveform can be established from a measurement of the sound emanating from the analog synthesizer or it can generated from a mathematical model of the analog synthesizer electronic circuitry. A preferred embodiment further comprising a control system software, said control system software can sense the sound generated by the analog synthesizer and adjust the calculated potentiometer positions, switch states and patch connections using close-loop feedback control methods to minimize the difference between the user requested waveform and the waveform represented the sound generated by the analog synthesizer. A preferred embodiment wherein the control system electronic application is capable of receiving a waveform on the display by manipulating an image of waveform and providing a mathematical definition of said waveform and generating positions on the knob, patch, or switches corresponding to said waveform.

A preferred embodiment is directed towards a sound generating analog synthesizer that is comprised of potentiometers, a switch or switches and a set of patch jacks has a control system that can be operated in three modes, a manual mode, an automatic mode, and a guided mode; wherein manual mode allows potentiometer and switch positions as well as patch cable connections to be set by hand; wherein automatic mode, automatically sets patch connections as on or off, as well as set potentiometer positions and switch states with electromechanical or electrical devices; and wherein the guided mode provides at least one visual information on how to change the potentiometer positions, switch states and patch jack connections such that a previously obtained sound can be reproduced.

A preferred embodiment is directed towards a method of generating a pre-determined sound on an analog synthesizer comprising: storing a sound on an analog synthesizer, said analog synthesizer comprising a controller electronically connected to rotate at least one knob, at least one switch, and at least one patch connection; said knob comprising a drive system, a shaft position sensor, and a potentiometer; wherein said controller rotates the at least one knob by generating instructions to said drive system; said at least one switch comprising an electronic connection to said controller to turn on or off said switch upon receiving instructions from said controller; and the at least one patch connection, comprising at least one patch switch, wherein said at least one patch switch controls connection between at least one input of said patch and at least one output of said patch; wherein storing comprises the positions of the potentiometer, at least one switch and the at least one set of patches; modifying at least one of the knob, switches, or patches, and returning to the stored sound by electronically modifying the at least one knob, switches, or patches to correspond to the positions of the potentiometer, at least one switch and the at least one set of patches. A preferred embodiment further comprising a knob display, a switch display, and a patch display, wherein the controller indicates on each of the knob display, switch display, and patch display, the desired positions of each of the knob, switch, and patches.

A further embodiment is directed towards a retrofit system for modifying an analog synthesizer, comprising an electronic control mechanism, a motor, position sensor, and signal potentiometer capable of controlling a knob, wherein said electronic control mechanism electronically communications with said motor, position sensor, and signal potentiometer to modify the position of said knob.

DETAILED DESCRIPTION OF THE EMBODIMENTS

Figure 1:
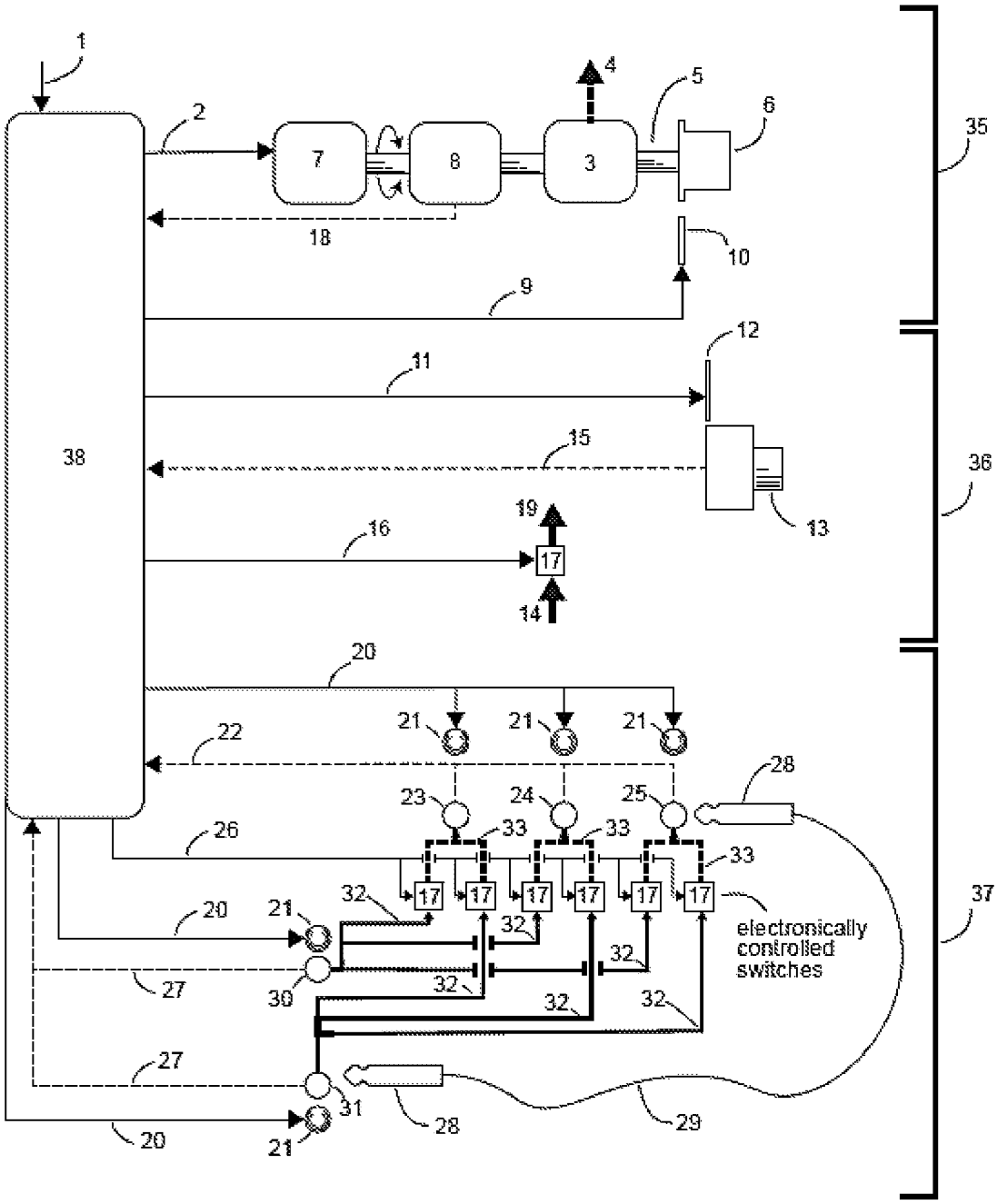
FIG. 1 depicts a summary of the electromechanical control of an analog synthesizer

FIG. 1 provides and overview of how the synthesizer controller 38 that can be implemented as hardware and/or software to control an analog synthesizer while preserving the analog audio signal path. The potentiometer control 35 depicts how the controller 38 controls the position of a potentiometer 3. As depicted in FIG. 1, the analog synthesizer comprises a rotary potentiometer, however, the invention and description is applicable to linear potentiometers as well. The controller 38 senses the shaft 5 position using the signal 18 sent from a potentiometer position sensor 8. Based on the specified desired setting for the potentiometer 3 that is provided to the controller as part of the controller input information 1, the controller determines the motion of the potentiometer shaft 5 to move the potentiometer to the desired position and generates a control signal 2 that is delivered to the potentiometer drive system 7. As the potentiometer position signal 18 the controller will update the potentiometer drive control signal 2 using a closed-loop control methodology until the position of the potentiometer 3 matches the desired position that is delivered to the controller as part of the controller input information 1.

As the potentiometer 3 position is changed, the signal delivered to the analog synthesizer 4 will change as well, but the signal 4 is not in electrical communication with the synthesizer controller 38. Therefore the signal 4 follows an entirely analog path as if it were a traditional analog synthesizer operated entirely manually As in a manually operated analog synthesizer, the knob 6 is directly connected with the potentiometer shaft 5. As the potentiometer 3 moves, the knob 6 will also move. Therefore, as the synthesizer controller 38 adjusts the position of the potentiometer 3 via the drive system 7, the user can visually see the change in position of the potentiometer 3 by visually observing the knob 6.

The synthesizer controller 38 also outputs a potentiometer display control signal 9 which is sent to an electronically controllable display 10. The display 10 provides the user information about the current potentiometer 3 position and saved positions. The display 10 can be any number of display devices, several of which are depicted in more detail in FIG. 2. Those of skill in the art will recognize the suitable display systems available to indicate position and other information that would be useable in these embodiments.

The potentiometer control 35 can be implemented in three modes. The first mode is fully automatic. In this mode the synthesizer controller 38 controls the position of the potentiometer 3, and thus the knob 6, to the position specified in the controller input information 1. Once the controller 38 receives the input, no action is required by the user.

In this fully automatic mode the display 10 can be used to show the current potentiometer 3 position and the desired potentiometer position that was included in the controller input information 1. In this mode, the user can use the display to see how close the knob 6, and thus potentiometer 3, are to their target position. One use of this information by the user is to estimate the time it will take the potentiometer 3 to arrive at the desired position.

The drive system 7 is designed such that the user can control the position of the potentiometer 3 at any time by manipulating the knob 6. The user can hold the knob 6 position fixed or change the position of the knob 6 while the drive system is attempting to position the potentiometer 3. The drive system 7 can achieve this by, but not limited to, a mechanical clutch, an electro-mechanical clutch or a stepper motor.

If the synthesizer controller is operating in fully automatic mode and the potentiometer 3 has achieved the desired position as specified in the controller input information 1, the drive system 7 can operate such that position of the potentiometer 3 is immediately returned to the desired position. If the user perturbs the position of the knob 6, and thus the position of the potentiometer 3, after the drive system has positioned it at the desired position as specified in the controller input information 1, the drive system will allow the user the override the drive system. However, immediately after the user releases the knob 6, the drive system 7 will return the potentiometer 3 and knob 6 to the desired position as specified in the controller input information 1.

The second potentiometer control 35 mode is a guided mode. In this mode the synthesizer controller disengages the drive system 7 such that the user can position the knob 6, and thus the potentiometer 3, manually in the same manner as when operating a manual analog synthesizer. In guided mode, the display 10 is used to guide the user to set the potentiometer 3 position to a desired position as specified in the controller input information 1. For example, a display would indicate current position of the knob 6 and a desired position. Arrows could indicate this, for example on an LCD display, or colored lights, flashing lights, or other visual cues to help the user locate the desired position.

The third mode of potentiometer control 35 is manual mode. In this mode the synthesizer controller disengages the drive system 7 such that the user can position the knob 6, and thus the potentiometer 3, manually in the same manner as when operating a manual analog synthesizer. The display 10 only presents the current position of the potentiometer and does not display a desired position as in the other modes. This manual mode duplicates the way a user interacts with a traditional manually operated analog synthesizer.

The switch control 36 illustrates how the synthesizer controller 38 electronically changes the state of a switch. Like the potentiometer, the switch control 36 also operates in manual mode, guided mode and/or fully automatic mode. In this embodiment, manual mode is accomplished by the user manually setting the state of the switch by depressing the momentary switch 13. The electrical signal from the momentary switch 15 is used by the synthesizer controller 38 to identify a change the state of the electronically controlled switch 17 is needed and to send a control signal 16 to the switch to execute that change. When closed, the switch 17 completes the circuit between analog synthesizer signals 14 and 19.

When operated in manual mode, the electronically controlled switch display 12 reflects the current state of the switch, 17.

In guided mode, the user again can change the state of the switch 17 by pressing the momentary switch 13, however, in this mode a switch display control signal 11 sends information to the controllable display 12 to indicate both the current state of the switch 17 as well as the desired state that is delivered to the controller 38 as part of the controller input information 1. The display 12 will indicate to the user when they have set the switch 17 to the desired state.

In the fully automatic mode the synthesizer controller 38 uses the switch control signal 16 to control the state of the electronic switch 17 in order to match the desired state that is part of the controller input information 1. In this mode the switch display 12 reflects the current and desired state and can show the user when they are equivalent.

In this embodiment the switch is single pole single throw type that connects or disconnects the incoming analog synthesizer electrical signal 14 and the outgoing analog synthesizer electrical signal 19. However, the switch control can be implemented with, but not limited to, single throw double pole switches although it is not pictured. In this and more complicated embodiments, the display 12 can be used to inform the user of the state of the switch. Additionally, the momentary switch 13 can be replaced with several momentary switches, a knob or other input device that allows the user to make a selection from more than 2 choices.

The automatic patch control 37 illustrates how the controller 38 can automatically or manually match patch jack connections. The patch control also operates in the same three modes as the other two devices: manual mode, guided mode and fully automatic mode. The figure shows that there are output patch jacks 30, 31 and input patch jacks 23, 24, 25. Outgoing signals generated by the analog synthesizer are connected to the output patch jacks. In the figure, the first output of synthesizer module one is connected to output patch jack 30. The first output of synthesizer module two is connected to output patch jack 31. Signals that are received by the synthesizer are connected to input patch jacks 23, 24, 25.

In manual mode, a patch connection as with a traditional manual analog synthesizer. In this mode, the user connects an output patch jack (30 or 31) to an input patch jack (23 or 24 or 25) with a cable 29 that has a connector 28 on each end that is received by a patch jack. The cable carries the analog synthesizer signal from the output jack to the input jack. Each patch jack is equipped to sense if a connection has been made with a cable 29 and that connection signal is sent to the controller as part of the input patch jack detection signals 22. There is an equivalent signal 27 from the output jacks to the synthesizer controller that indicates to the controller what output jacks have been connected. The signals 22 and 27 work in combination so the controller 38 can identify any patch jack pair connected by a cable 29. The patch jack displays 21 indicate to the user the connections that have been made between patch jack pairs by the cable 29. The controller 38 uses the patch jack display control signal 20 to In fully automatic mode, the controller 38 sends a command to the electronically controlled switches 17 that are part of the automatic patch control 37. The command is delivered to the switches 17 by the switch control signal 26. Each switch 17 can be controlled individually and independently of the others. The switches 17 in the automatic patch control are connected to the analog synthesizer output jacks 30, 31 by means of electronic connections 32. The Connections 32 enable the signal from patch jack 30 or 31 to reach any of the input jacks 23, 24, 25. However, there is no direct connection between the output patch jacks. The switches 17 are operated by the controller 38 such that output 30 and output 31 are never electrically connected.

Connections 33 connect all of the switches 17 in the automatic patch control to the input patch jacks 23, 24, 25. The switches in the automatic patch control 17 are controlled by the controller 38 such that an analog synthesizer signal output from one of the patch jacks 30, 31 will only be sent to one of the input patch jacks 23, 24, 25 at a time.

In guided mode, the displays 21 are used to indicate to the user which patch connection pairs are desired as included in the input information to the controller 1. When the connection is made by the user using a cable 29 with connectors 28, the controller can identify the input jacks 23, 24, 25 and output jacks 30, 31 that have been connected from the output patch jack sensor signal 20 and input patch jack sensor signal 22. The displays 21 are used to indicate the desired patch connection as well as the actually patch connections so the user can confirm the desired connections have been made and correct mistakes if necessary.

In one embodiment the displays 21 could use matching colors to indicate a pair of jacks that are connected. In another embodiment the displays could use graphics and/or text to indicate the connected patch jack pairs. When in manual mode, the displays only reflect the current state of the patch connections. In guided or fully automatic mode the displays 21 can indicate both the current state of any patch connection as well as the desired patch connections as provided in the controller input information 1.

The invention is not limited to 5 patch jack connectors. The automatic patch control 37 can be extended to any number of input and output patch jacks.

In the embodiment shown in FIG. 1, any connection cables 29 connected to the patch jacks 23, 24, 25, 30, 31 must be removed manually by the user for the synthesizer controller 38 to control the patch connections. In an another embodiment, it is possible to add additional switches 17 that would allow the user to keep the cable 29 with connectors 28 inserted into patch jacks, but electrically isolated from an analog synthesizer such that the automatic connections made with connectors 32, 33 can be made without removing cables 29.

Figure 2:
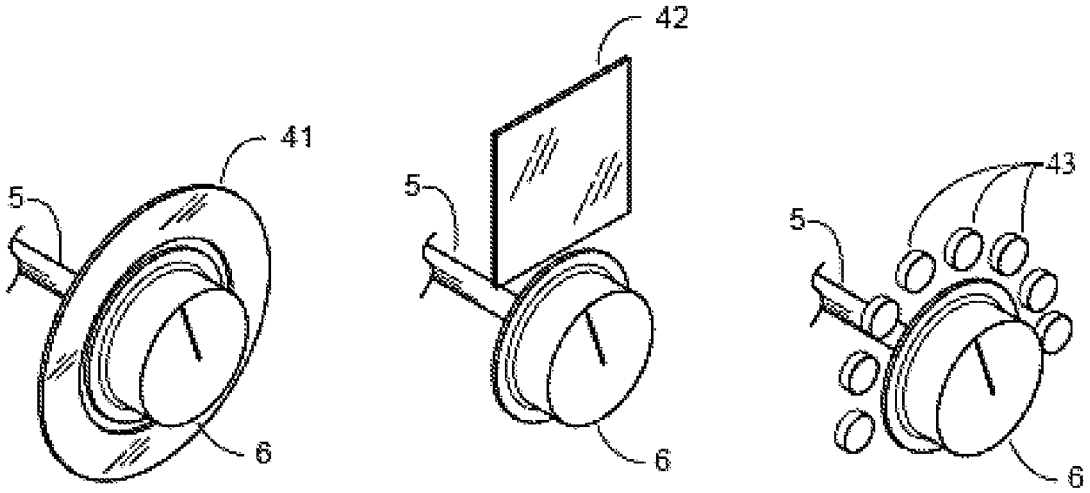
FIG. 2 depicts embodiments of potentiometer interactive displays

FIG. 2 provides embodiments of interactive displays for rotary and linear potentiometers. Such displays can replace any of displays 10, 12, or 21 in FIG. 1. Display 41 is located around the circumference of the knob 6 which is connected to shaft 5. In this embodiment, the display 41 could be a liquid crystal display that uses pixels to generate programmable images, text and color. In this arrangement, the display can emulate the traditional tick marks to represent angular position of the knob 6 and shaft 3. However, because the display can be change by the controller 38, the tick marks can be manipulated in size, color and location to indicate current knob position as well as desired position.

Another embodiment shown in FIG. 2 is display 42. The rectangular share lends itself to providing information in the form a graphics and text. Another embodiment of a rotary potentiometer knob 6 display 43 uses discrete light emitting diodes (LEDs) arranged in a semi-circular pattern around the knob 6. In this embodiment, the color and intensity of the individual LEDs can be changed by the controller 38 to indicate current knob 6 position as well as desired position. Additionally, flashing the LEDs 43 at different frequencies can also be used to communicate information to the user.

Figure 3:
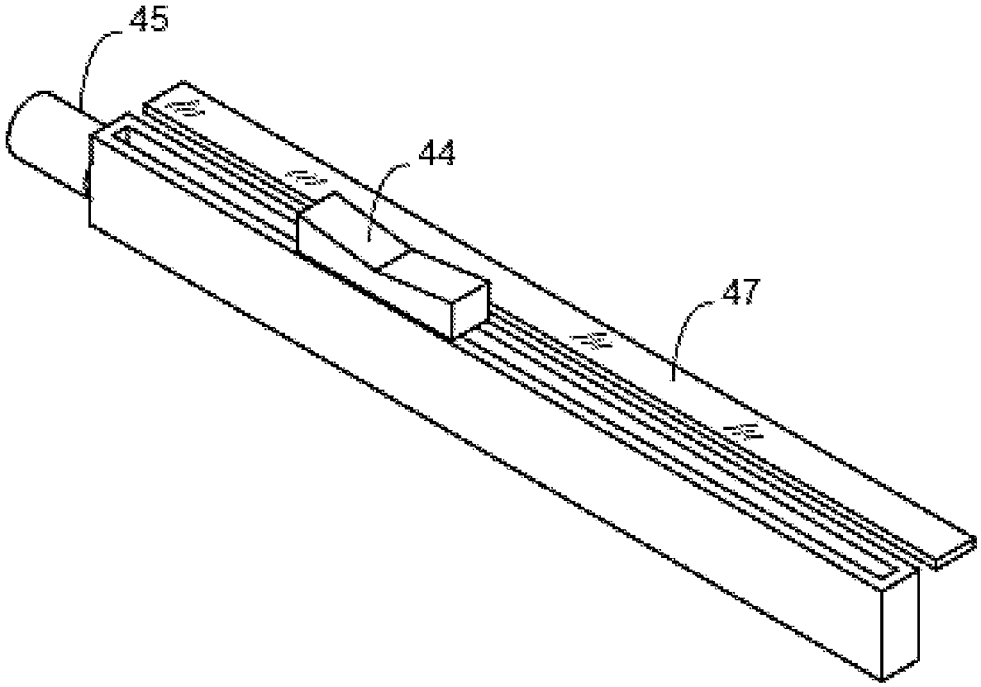
FIG. 3 depicts a linear potentiometer display.

FIG. 3 details a linear potentiometer display 47 can be utilized. In this embodiment, the slider 44 moves the linear potentiometer manually. The drive system 45 drives based on instructions from the synthesizer controller 38. The display 47 can be a liquid crystal display and, similar to FIG. 2, display traditional tick marks, it can also include graphics and text to provide the user information about the current position of the slider 44 and the desired position as provided in the controller input information 1.

Figure 4:
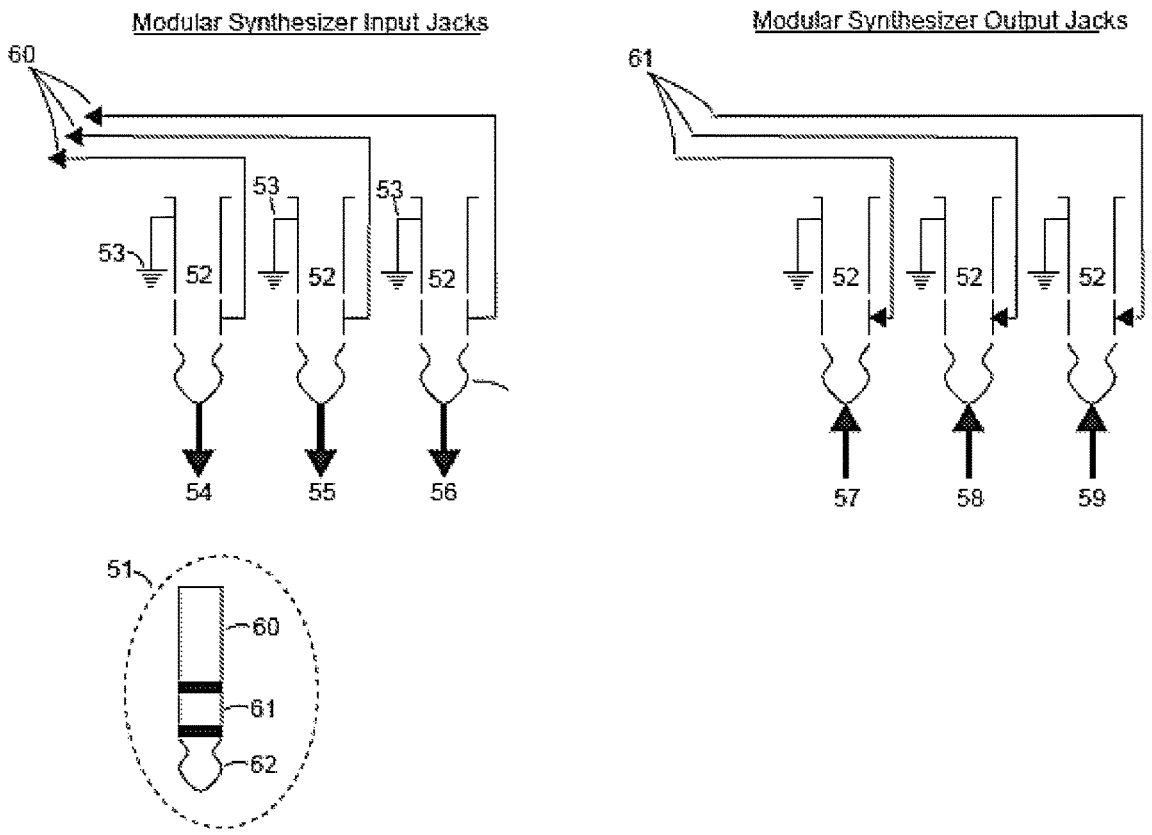
FIG. 4 depicts an embodiment of automatic patch connection detection.

FIG. 4 provides an embodiment of a patch jack sensor system that allows the controller 38 to detect patch jack connections made manually by the user with a cable 29. Here stereo phono connectors 51 and jacks 52 are used to create a path for the analog synthesizer audio signals as well as patch connection information. Each stereo connection has a path for ground 60, an analog synthesizer signal 62 as well as an additional channel to carry patch connection information 61. The input and output patch jacks 52 have 3 corresponding channels as well. The ground 53 is common to all of the patch jacks. Each patch jack is connected to a unique signal associated with the analog synthesizer 54, 55, 56, 57, 58, 59. The third channel on each patch jack is used by the controller to send a signal using connections 61 and then test to see if it is received using connections 60. Each output patch jack connection 61 can be sent an individual signal by the controller 38 and each input patch jack connection signal output 61 can be sensed for each individual input jack. Once a signal is applied to an output jack using connections 61, each of the input jack connection signals 61 can be checked by the controller. Any input jack that transmits the signal provided to the output jack is established to be connected electrically to the output jack to which the signal was sent.

Figure 5:
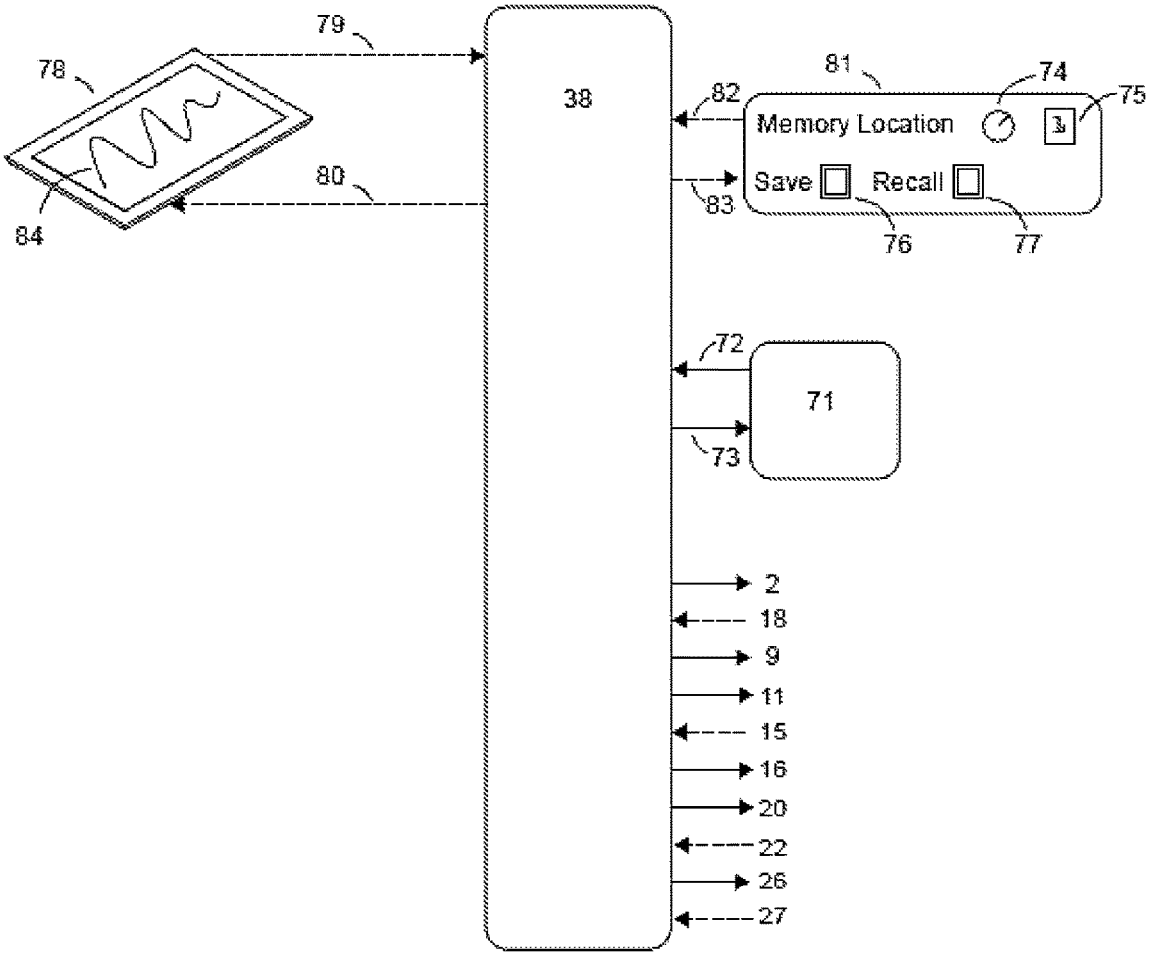
FIG. 5 depicts the synthesizer controller user interface embodiments.

FIG. 5 provides a description of how the synthesizer controller 38 is provided input information. The basic interface 81 allows the user to specify a memory location via a selector 74 and a display 75 that indicates the current user selected memory location.

The user can indicate to the controller 38 to save the current potentiometer positions, switch states and patch connections to the selected memory location by selecting the save mode using a user interface 76. One embodiment of the user interface 76 is a momentary switch, but it is not limited to this embodiment. When the user selects to save the current potentiometer positions, switch states and patch connections, the information is obtained from signals 18, 16, 22, 27 shown in FIG. 5 and FIG. 1 are stored in memory 71 via an output to the memory module 73. Transmission of information and data between the controller 38 and the basic interface 81 is provided via output 83 and input 82.

The user can also indicate to the controller 38 to recall potentiometer positions, switch states and patch connections from the selected memory location by selecting the recall mode using user interface 77. One embodiment of the user interface 77 is a momentary switch, but is not limited to this embodiment. When the recall mode is activated, the controller 38, retrieves the potentiometer, switch and patch connection information from the memory module 71 via the output connection 72. If the controller 38 is in fully automatic mode, the potentiometer positions, switch states and patch connections will be adjusted without user input to match the recalled settings. If the controller 38 is in guided mode, the displays 10, 12, 21 shown in FIG. 1 will update to provide the user information on how to manually make adjustments to return the analog synthesizer to the saved state. Communications, as depicted in FIG. 1 and again here in FIG. 5 including those of 2, 18, 9, 11, 15, 16, 20, 22, 26, and 27, which allow for communication between the controller 38 and the various components necessary to move or generate an indication signal to assist the user in various modes of operation.

Another interface for input by the user is an electronic interactive display 78. One embodiment of the interactive display 78 is a portable electronic device with a touch sensitive screen and an electronic application to receive user input and display waveform information 84. The user can use the interactive display 78 to generate a new sound by constructing a waveform 84 that represents the frequency and amplitude information of a desired sound. The waveform 84 can be generated by the user drawing a waveform by hand on the interactive display 78. The waveform can also be generated by inputting parameters for a mathematical model of a waveform. Alternatively, a waveform can be loaded onto the display 78.

The controller 38 can receive the waveform information 79 and using a mathematical model of the analog synthesizer circuitry, can generate a set of potentiometer positions, switch states and patch connections that will match the user specified waveform as closely as possible.

The controller 38 can provide the interactive display with data and waveform information regarding the response of the potentiometers, switches and patch connections as well as the waveform of the sound actually produced by the via the output signal 80.

The synthesizer controller 38 can be operated such that it continuously updates the potentiometer positions, switch states and patch connections as the user changes the input waveform 84. In this way the user can "play" the synthesizer by describing (or drawing) the desired sound directly without ever directly specifying potentiometer, switch and patch connection information as is required for traditional manual synthesizers.

The basic interface 81 can be used to store any sound generated by the interactive waveform display 78. The interface 81 can store any number of sounds and allow for real-time display of the waveform on the display 78, simultaneous to the production of the sound on the analog device. Use of the device and a control system (software or a display unit), allow for modification of the analog synthesizer as described herein. The control system electronic application can allow the user to manipulate the displayed waveform that represents the sound that is generated by the analog synthesizer. The electronic application calculates the potentiometer positions, switch states and patch connections in order to achieve the closest waveform possible to the user requested waveform. The control system can use the guided manual or automatic methods of setting the analog synthesizer potentiometer, switch and patch connections to match those calculated to generate the desired waveform. Such control systems can perform the necessary mathematical calculations, and then interact with the controller and other electronic systems to make the necessary changes or direct the appropriate information to displays to enable the user to make the necessary changes to reach the particular wave form on the display.

Figure 6:
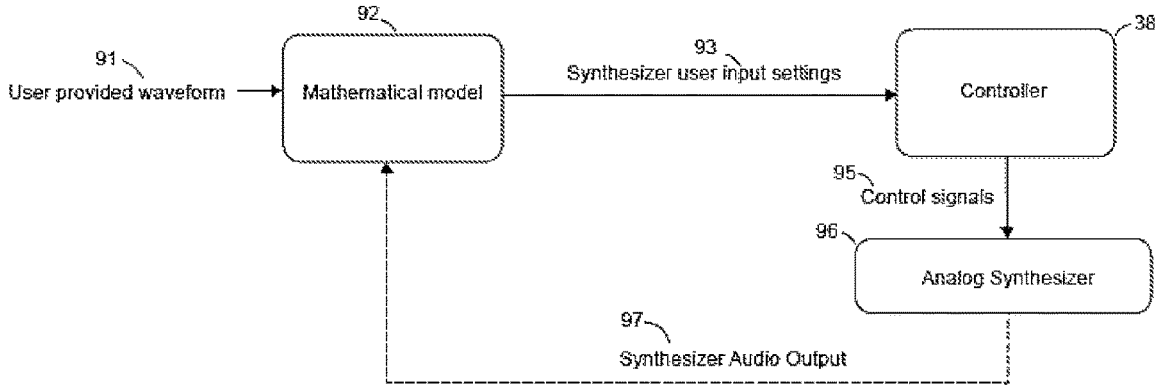
FIG. 6 depicts the process of automatic sound wave generation

FIG. 6 provides a flow chart for the process of creating a sound from an analog synthesizer by providing a waveform shape 91 to the controller 38. The process begins with a user specified waveform 91, for example one drawn on a waveform display 78. The waveform can be drawn, generated from mathematical parameters that are part of a mathematical model, from a recording or from digital file information.

The waveform data 91 is provided to a mathematical model of the analog synthesizer circuitry. The mathematical model is used to determine the potentiometer positions, switch states and patch connections that will generate a sound with a waveform that is as close to the user specified information (waveform data) 91 as possible. The mathematical model can be implemented in a computer program such that it iteratively adjusts potentiometer positions, switch states and patch connections until the predicted analog synthesizer output sound waveform is as close to the desired waveform as possible as determined by the computer program.

The mathematical model 92 will generate a set of potentiometer positions, switch states and patch connections 93 and provide that information to the synthesizer controller 38. The controller 38 will use the means shown in FIG. 1 to set the potentiometer positions, switch states and patch connections by means of a set of control signals 95. The analog synthesizer 96 potentiometers, switches and patch connections setting will generate a particular audio output 97 based on the settings 93 and control signals 95. The mathematical model 92 can receive the waveform information of the generated sound and use it to modify the predicted potentiometer positions, switch states and patch connections by means of closed-loop-feedback control.

Accordingly, the device is an analog synthesizer that comprises a plurality of knobs and patches that can be utilized on one of several modes, either manually (as a normal analog synthesizer), guided mode—where the device indicates positions with displays, or in fully-automated mode, wherein the device controls the knobs and patches to generate a sound.

Various displays are utilized throughout to indicate positions of knobs and patches and a waveform display provides a visual cue of the actual sound being played.

Accordingly, a preferred embodiment is directed towards an automated analog synthesizer, comprising at least one knob connected to a shaft, wherein a potentiometer and a shaft position sensor receive and generate electrical information to and from a controller, wherein the controller determines the position of the potentiometer shaft to move the potentiometer to the desired position and generates a control signal that is delivered to a potentiometer drive system; as the potentiometer position signal the controller will update the potentiometer drive control signal using a closed-loop control methodology until the position of the potentiometer matches the desired position that is delivered to the controller as part of the controller input information. Simultaneously, a switch system connected to the controller, allows for binary on/off control of one or more switches, either in manual, guided, or automatic mode, to control the position of one or more switches. Finally, a patch system, connected to the controller, connects one or more inputs to one or more outputs via electronically controlled switches. In certain embodiments, the controller is then connected to a waveform display, which is capable of depicting and displaying the waveform of the sound being generated by the current position of all knobs, switches and the various patch connections.

Embodiments of the present disclosure are directed towards devices and methods that incorporate or use these devices, which are analog synthesizers. In preferred embodiments, an analog synthesizer comprises at least one knob, at least one switch, and at least one patch. In preferred embodiments, the knob is automated comprising a potentiometer a shaft position sensor and a drive system, wherein the components are electrically connected to a controller to determine the proper position of the knob. Preferably, a knob display control signal provides a display on a knob position display. In further embodiments, a switch is automated, wherein a momentary switch is electronically connected to said controller and comprising a switch display signal providing a visual display of the position of the switch. The knob control (potentiometer control) can be used alone, or in combination with the automatic switch control.

Additionally, analog synthesizers comprise a series of patches, comprising an input and an output that is traditionally connected manually with a cable, having connectors at each end. In the embodiments and figures herein, the manual application is supplemented with a series of switches that electronically connect each of the different inputs to each of the different outputs, and thus allows for automatic connection between each possible orientation of the patches. This patch component can be utilized individually on an analog synthesizer or be combined with one or more of the potentiometer control or the switch control features as described herein.

Methods of performing on an analog synthesizer are contemplated herein, wherein automatic control between a first sound and a pre-determined sound stored within memory comprises: generating a sound wave comprising a first set of conditions for at least one knob, at least one patch connection, and at least one switch; generating a second sound wave comprising a second set of conditions for the at least one knob, at least one patch connection, and at least one switch, wherein the second sound wave is automatically generated via electronic controls corresponding to the at least one knob, at least one patch, and at least one switch. In preferred embodiments, the second sound wave is modified by the control system, to move at least one knob, at least one patch connection, or the at least one switch, or a combination of two, or all three until the second sound wave more closely matches the first sound wave. These modifications are performed electronically via accessing a pre-saved sound wave from memory and wherein the electronic system modifies the analog components to generate the pre-saved sound wave on the analog synthesizer device.

A further method comprises generating a pre-determined sound wave on an analog synthesizer by storing information comprising at least one of a potentiometer signal for controlling at least one knob, at least one switch signal, and at least one patch connection between at least one input and at least one output patch, wherein the stored information can be utilized to re-generate the same positions on the analog synthesizer to generate the pre-determined sound wave.

A further embodiment is directed to a method of generating a sound on an analog synthesizer by drawing a sound wave on a digital display; wherein the analog synthesizer comprises at least one electronically controlled knob, at least one electronically controlled switch, and at least one electronically controlled patch connection; wherein the sound wave drawn on the digital display is analyzed by a controller receiving the sound wave description and using a mathematical model of the analog synthesizer circuitry, the controller can generate a set of potentiometer positions, switch states and patch connections that will generate a sound with a waveform that matches the user specified waveform as closely as possible. In preferred embodiments, the controller determines a first set of expected positions, and compares the drawn sound wave to the actual sound wave being generated by the then existing positions; wherein the controller compares the two sound waves and modifies one or more of the expected positions to best fit the sound wave to the mechanical positions on the analog synthesizer.

In certain embodiments, the components as described herein can be a retrofit kit, comprising software (a control system), and a controller, connected to the components for controlling the knob, switch, and patch controls. Specifically, a kit comprises a drive system, a shaft position sensor, a potentiometer, and a display for said knob control. An electronic switch for controlling the switch control. And at least one switch for generating electronical connections for automatic patching. These components can be installed on an analog synthesizer and generate a device capable of automatically modifying the various controls to store and generate positions of the components to create saved or pre-determined wave forms.

Those of skill in the art will recognize that numerous devices can be utilized to generate the input from an oscillator that is sufficient to generate the modified sounds utilized herein. Suitable amplifiers and generates can be further added, so that those who seek to play music with these devices can generate sufficient sounds from the analog synthesizer device described herein.

What is claimed is:

1. A sound generating analog synthesizer comprising a controller electronically connected to rotate at least one knob, actuate at least one switch, and make at least one patch connection; said knob comprising a drive system, a shaft position sensor, and a potentiometer; wherein said controller rotates at least one knob by generating instructions to said drive system; said at least one switch comprising an electronic connection to said controller to turn on or off said switch upon receiving instructions from said controller; and at least one patch connection, comprising at least one patch switch, wherein said at least one patch switch controls connection between at least one input of said patch and at least one output of said patch; and wherein the controller can electronically modify each of at least one knob, at least one switch, and at least one set of patch connections.

2. The sound generating analog synthesizer of claim 1, wherein said potentiometer detects a position of said knob.

3. The sound generating analog synthesizer of claim 1, comprising at least one of the group selected from: a knob position display, a switch display, a patch connection display, or combinations thereof.

4. The sound generating analog synthesizer of claim 3, wherein a knob position display, a switch display, or a patch connection display generates an indication identifying a current position and a desired position, wherein said desired position corresponds to a pre-determined sound wave.

5. The sound generating analog synthesizer of claim 1, comprising an electronic application and memory configured to said controller, enabling the controller to transmit information to the analog synthesizer controller to change the position of the potentiometer, state of the switches, or state of the patch connections.

6. The sound generating analog synthesizer of claim 5, wherein the memory configured to said controller enables storage of all of the potentiometer, switch and patch connection settings required to create a particular sound in electronic memory.

7. The sound generating analog synthesizer of claim 6 wherein the analog synthesizer can recall the potentiometer, switch and patch connection settings to re-create a stored sound.

8. The sound generating analog synthesizer of claim 7, wherein the controller can restore a previous state by using an electronic display that guides the user to manually position the potentiometers to the stored setting, set the state of the switches and set the state of the patch connections.

9. The sound generating analog synthesizer of claim 7, wherein the controller can restore a previous state by automatically modifying the potentiometer, switch and patch connections without user assistance.

10. The sound generating analog synthesizer of claim 7, wherein the controller is connected to a display, wherein said display depicts the sound wave being generated by the analog synthesizer as a waveform.

11. The sound generating analog synthesizer of claim 10, wherein the waveform can be established from a measurement of the sound emanating from the analog synthesizer or it can generated from a mathematical model of the analog synthesizer electronic circuitry.

12. The sound generating analog synthesizer of claim 10, further comprising a control system software, said control system software can sense the sound generated by the analog synthesizer and adjust the calculated potentiometer positions, switch states and patch connections using close-loop feedback control methods to minimize the difference between the user requested waveform and the waveform represented the sound generated by the analog synthesizer.

13. The sound generating analog synthesizer of claim 12 wherein the control system electronic application is capable of receiving a waveform on the display by manipulating an image of waveform and providing a mathematical definition of said waveform and generating positions on the knob, patch, or switches corresponding to said waveform.

14. A sound generating analog synthesizer comprising a controller electronically connected to rotate at least one knob, actuate at least one switch, and make at least one patch connection, and at least one electronic interface; said knob comprising a drive system, a shaft position sensor, and a potentiometer; wherein said controller rotates at least one knob by generating instructions to said drive system; said at least one switch comprising an electronic connection to said controller to turn on or off said switch upon receiving instructions from said controller; and at least one patch connection, comprising at least one patch switch, wherein said at least one patch switch controls connection between at least one input of said patch and at least one output of said patch; and wherein said electronic interface is suitable for drawing or entering mathematical parameters of a wave form capable of being generated via modification of the at least one knob, at least one switch, and at least one set of patch connections.

15. The sound generating analog synthesizer of claim 14, further comprising at least one of the group selected from: a knob position display, a switch display, a patch connection display, or combinations thereof, wherein a wave form of said electronic interface correspond to a particular knob position, switch position, and patch connections, and wherein the position corresponding to a wave form is indicated by an indicator on the knob position display, switch display, patch connection display or a combination thereof.

16. The sound generating analog synthesizer of claim 15, wherein said controller comprises a control system comprising computer software defined to control at least one knob, at least one switch, and at least one set of patches, and said controller can receive information from the analog synthesizer control system and display data regarding the potentiometer, switch and patch settings.

* * * * *